United States Patent [19]

Akutsu et al.

[11] Patent Number: 5,045,382

[45] Date of Patent: Sep. 3, 1991

[54] THERMAL INK-TRANSFER RECORDING MEDIUM

[75] Inventors: Eiichi Akutsu; Hiroo Soga; Koichi Saito; Kiyoshi Horie, all of Kanagawa, Japan

[73] Assignee: Fuji Xerox Co., Ltd., Tokyo, Japan

[21] Appl. No.: 492,348

[22] Filed: Mar. 8, 1990

Related U.S. Application Data

[63] Continuation of Ser. No. 399,355, Aug. 28, 1989, abandoned, which is a continuation of Ser. No. 217,784, Jul. 12, 1988, abandoned.

[30] Foreign Application Priority Data

Jul. 16, 1987 [JP] Japan ..... 62-176043

[51] Int. Cl.[5] ..... B41M 5/26

[52] U.S. Cl. ..... 428/216; 428/195; 428/207; 428/213; 428/214; 428/215; 428/323; 428/327; 428/332; 428/333; 428/334; 428/335; 428/336; 428/913; 428/914; 204/2

[58] Field of Search ..... 428/195, 209, 212, 216, 428/484, 913, 914, 323, 207, 213–215, 327, 332–336; 204/2

[56] References Cited

U.S. PATENT DOCUMENTS 4,479,997 10/1984 Masterson et al. ..... 428/211
4,775,578 10/1988 Hayashi et al. ..... 428/216

FOREIGN PATENT DOCUMENTS 53-84735 5/1978 Japan ..... 428/195
56-93585 11/1981 Japan ..... 428/195

OTHER PUBLICATIONS

Journal of the Institute of Image Electronics Engineers of Japan, 1982, vol. 11, No. 1–Only Summary in English.

*Primary Examiner*—Pamela R. Schwartz
*Attorney, Agent, or Firm*—Finnegan, Henderson, Farabow, Garrett and Dunner

[57] ABSTRACT

A thermal ink-transfer recording medium of the present invention comprises: an anisotropically electroconductive layer formed by dispersing an electroconductive powder with an average particle size of 10 μm to 2 mm in a thermosetting resin, shaping the blend into sheet form, and heat-curing the sheet while being compressed in the direction of its thickness; a heat-generating resistive layer; a pickup electrode layer; an ink release layer; and a heat-fusible ink layer that is capable of being fused by the heat generated from said heat-generating resistive layer.

5 Claims, 2 Drawing Sheets

THERMAL INK-TRANSFER RECORDING MEDIUM

This application is a continuation of application Ser. No. 07/399,355, filed Aug. 28, 1989 which is a continuation of application Ser. No. 217,784, filed July 12, 1988 both now abandoned.

BACKGROUND OF THE INVENTION

The present invention relates to a medium for use in a thermal ink-transfer, recording method in which electrical signals are converted to thermal energy that melts solid ink so that it can be transferred to a recording sheet to form a final image.

Images corresponding to predetermined digital image signals have commonly been recorded on base paper such as plain paper by employing thermal ink-transfer recording media such as ink donor films.

The following three principal techniques are currently employed to implement the thermal ink-transfer recording process:

1) Method for Transferring with a Thermal Head

Using a thermal head with an array of heat generating elements, theremal pulses are selectively applied to the backside of an ink-coated base film, with the ink coating being positioned to face a recording sheet, and the ink in the heated areas of the base film is fused or allowed to sublime so that it is transferred to the recording sheet (see Japanese Patent Application (OPI) No. 84735/1978; the term OPI as used hereinafter means an unexamined published Japanese patent application);

2) Method for Transferring by Current Impression

Stylus electrodes are brought into contact with an ink-coated base film and the ink layer is heated with Joule's heat generated by selective current impression, with the melting ink being transferred to a recording sheet; in this technique, electroconductivity is imparted to the base film by dispersing a conductive material such as a metal in the matrix resin or by using a conductive high-molecular weight resin with high resistance; the ink layer is formed of an ink composition containing a highly conductive material (see the Journal of the Institute of Image Electronics Engineers of Japan, vol. 11, No. 1, pp. 3-9, 1982); and 3) Method for Printing by Thermal Transfer Similar in principle to 2), this technique does not heat the ink layer by direct application of current but by current impression on a heat-generating resistive layer formed between the base film and the ink layer, with the melting ink being transferred to a receiving sheet (see Japanese Patent Application (OPI) No. 93585/1981).

A thermal ink-transfer recording medium used with the third technique is shown in FIG. 4. As shown, it consists of an electro-conductive base film 43 laminated in sequence with a heat-generating resistive layer 44, a conductive layer 45 and an ink layer 46. In order to perform recording with this medium, stylus electrodes 41 and a pickup electrode 42 are placed in contact with the backside of the medium, with the stylus electrodes 41 being arranged in a row and directed normal to the paper. Electrical pulses are selectively applied to some styli in response to image signals. An electric current flows in the direction indicated by the arrow so as to heat the heat-generating resistive layer 44, which then produces heat that melts and softens a selected portion 48 of the ink layer 46 so that it is transferred to a recording sheet 47.

The conventional techniques of thermal ink-transfer recording process involve the following problems and have not been considered to be completely satisfactory for practical purposes.

In the method of transfer with a thermal head, heat is transmitted from the thermal head to the ink layer through the base film, so that a time lag occurs in recording that corresponds to the time of heat conduction (i.e., about 1 msec which is equal to the time constant) and this slows down the recording. Another problem arises from the low level of the thermal energy to be transmitted, which necessitates the use of a low-melting point ink and thereby reduces the latitude of choice in selecting ink materials, with the attendant disadvantage of poor controllability of ink transfer. As a result, it has been difficult to modulate the recording density of dots and the only kind of ink material that can be used are those which are based on wax.

The method of transfer by current impression has the disadvantage that it is very difficult to produce a color image because the conductive material incorporated in the ink introduces the problem of increasing the difficulty of color control. Besides the power loss resulting from the bulk resistance of the base film, loss also occurs on account of the spread of current over the major surface of the film. This reduces not only the power efficiency but also the precision of positioning of the recorded dots. As a further problem, the conductive material incorporated in the base film reduces the quality of the mechanical properties of the latter.

The method of printing based on thermal transfer has the advantage that electroconductivity need not be imparted to the ink used and that there is a great latitude in the choice of ink materials. However, this method still suffers from the disadvantages of great loss due to the spread of current and low precision in the positioning of recorded dots. Furthermore, as is clear from FIG. 4, the base film 43 must have an adequately high resistance compared with the heat-generating resistive layer 44 and this inevitably increases the contact resistance at the interface between the base film and the stylus electrodes 41 and pickup electrode 42. In addition, the current supplied from the stylus electrodes 41 will be picked up by the electrode 42 after flowing through a path consisting of the base film 43, heat generating resistive layer 44 and the conductive layer 45. Because of the presence of two contact areas in the current path, a great loss will occur in the electrical energy.

SUMMARY OF THE INVENTION

An object, therefore, of the present invention is to provide an improved thermal ink-transfer recording medium that is free from all of the aforementioned problems of the conventional art.

This object of the present invention can be attained by a recording medium comprising: an anisotropically electroconductive layer formed by dispersing an electroconductive powder with an average particle size of 10 $\mu$m to 2 mm in a thermosetting resin, shaping the blend into sheet form, and heat-curing the sheet while being compressed in the direction of its thickness; a heat-generating resistive layer; a pickup electrode layer; an ink release layer; and a heat-fusible ink layer that is capable of being fused by the heat generated from said heat-generating resistive layer.

DETAILED DESCRIPTION OF THE INVENTION

Figure 1:
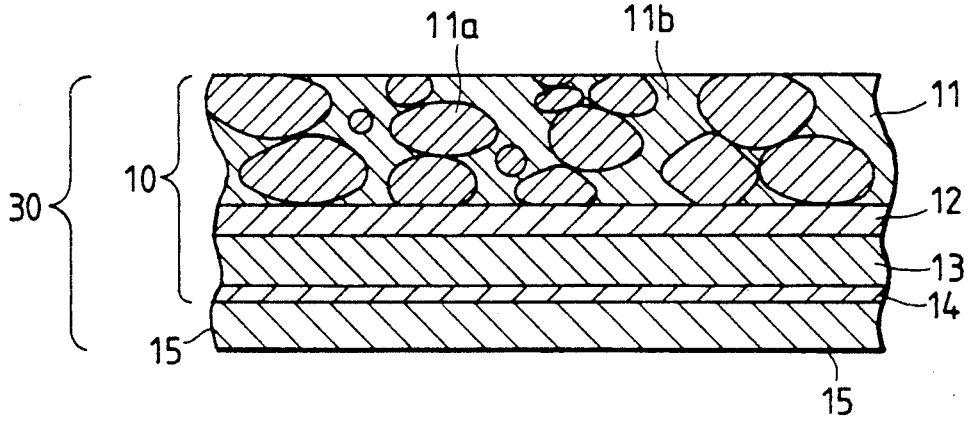
FIG. 1 is a cross section showing schematically a thermal ink-transfer recording medium according to an embodiment of the present invention.

The structural composition of the recording medium of the present invention is described hereinafter with reference to the accompanying drawings. FIG. 1 is a longitudinal section showing the basic structure of the thermal ink-transfer recording medium 30 of the present invention. As shown, the medium 30 comprises a support 10 and a heat-fusible ink layer 15, with the support 10 comprising an anisotropically electroconductive layer 11 that is more conductive in the direction of its thickness than in the direction of its width, a heat-generating resistive layer 12, a pickup electrode layer 13 and an ink release layer 14.

The anisotropically electroconductive layer 11 is prepared by dispersing a conductive powder 11*a* with an average particle size of 10 μm to 2 mm in a thermosetting resin 11*b*, shaping the blend into sheet form, and heat-curing the sheet while being compressed in the direction of its thickness. The conductivity of the layer 11 in the direction of its thickness is preferably at least 10 times as large as the conductivity in the direction of its width. For example, the resistance of the layer 11 in the direction of its thickness is 10 $\Omega/mm^2$ or less, preferably $10^{-1}$ $\Omega/mm^2$ or less, and the resistance in the direction in its width is at least $10^5$ $\Omega/mm^2$, preferably at least $10^{11}\Omega/mm^2$. The thickness of the layer 11 is set to be within the range of 20 μm to 5 mm.

The electroconductive powder for use in preparing the layer 11 is a granular material having a volume resistivity of 10 Ω·cm or less. The average particle size of the powder is preferably not more than 50 μm, and the standard deviation of its size distribution is preferably not more than and 10 μm. Suitable conductive powders include those of metals such as Ni, Au, Ag, Fe, Al, Ti, Cu, Co, Cr, Pt, and the like and conductive ceramics such as $VO_2$, $Ru_2O$, TaN, SiC, $ZrO_2$, $Ta_2N$, ZrN, NbN, Vn, $TiB_2$, $ZrB_2$, $HfB_2$, $TaB_2$, $MoB_2$, $CrB_2$, $B_4C$, MoB, ZrC, VC, TiC and the like.

Preferred thermosetting resins have a volume resistivity of at least $10^5$ Ω19 cm and may be selected from among known types including silicone resins, epoxy resins, unsaturated polyester resins, polyimide resins, polyimideamide resins, and polysulfone resins.

Figure 2:
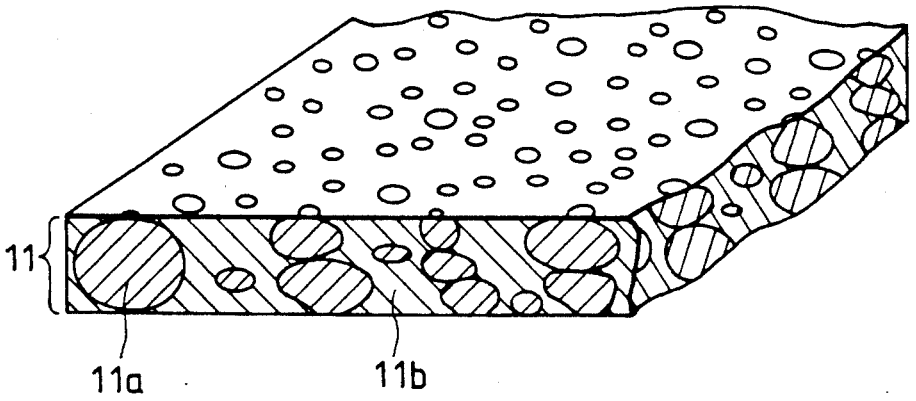
FIG. 2 is a perspective view of an anisotropically electroconductive layer formed in the recording medium of the present invention.

FIG. 2 is a perspective view of the anisotropically electroconductive layer 11. This layer 11 is prepared by curing the conductive resin sheet while being compressed in the direction of its thicknesss. Because of the nature of the process employed to make it, in the layer 11, chains of the conductive particles 11*a* dispersed in the thermosetting resin 11*b* are formed so as to extend in the direction of the thickness of the layer 11, as shown in FIG. 2. The chains of the conductive particles act as conduction paths.

The heat-generating resistive layer 12 is formed as a thin film on the anisotropically conductive layer 11 by sputtering a mixture of a high-resistance material such as $ZrO_2$, $Al_2O_3$, $SiO_2$ and the like and a conductive material such as Ti, Al, Cu, Au, Zr, and the like. The resistance of the heat-generating resistive layer 12 is preferably set at a value within the range of $10^{-3}$ to $10^{-2}$ Ω·cm, with its thickness being preferably set at a value in a rang of 1000 Å to 3 μm.

The pickup electrode layer 13 is formed of a material having a volume resistivity of not higher than $10^{-1}$ Ω·cm formed through evaporation, sputtering or some other suitable thin film forming process. The thickness of this layer is preferably set at a value within the range of 500 Å to 5 μm.

The ink release layer 14 is made of a thin film having low surface energy and basically it has a lower critical surface tension than the surface energy of the receiving sheet. If the receiving sheet is plain paper, this layer must have a critical surface tension of not greater than 43 dynes/cm. Preferably, the critical surface tension of the ink release layer is lower than the surface tension of the ink, since such an ink release layer is highly effective in facilitating ink transfer to the receiving sheet. The ink release layer is typically formed of a fluorine resin, a silicone resin or the like and its thickness is preferably minimized to lie within the range of 500 Å to 6 μm.

The heat-fusible ink layer 15 is formed of a thermoplastic resin that has a melting point of not higher than 130° C. and which has a known colorant (i.e., dye or pigment) dispersed therein. The thickness of the heat-fusible ink layer 15 is preferably set at a value within the range of 1 to 15 μm.

Figure 3:
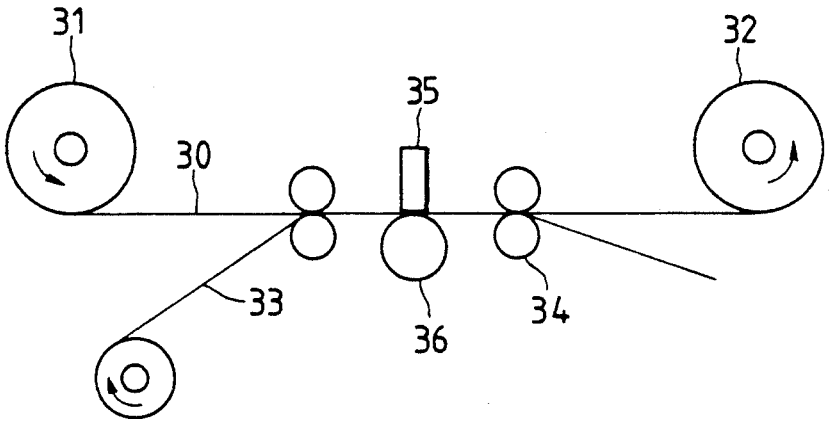
FIG. 3 is a diagram showing the layout of an apparatus for performing thermal ink-transfer recording with the medium of the present invention.
Figure 4:
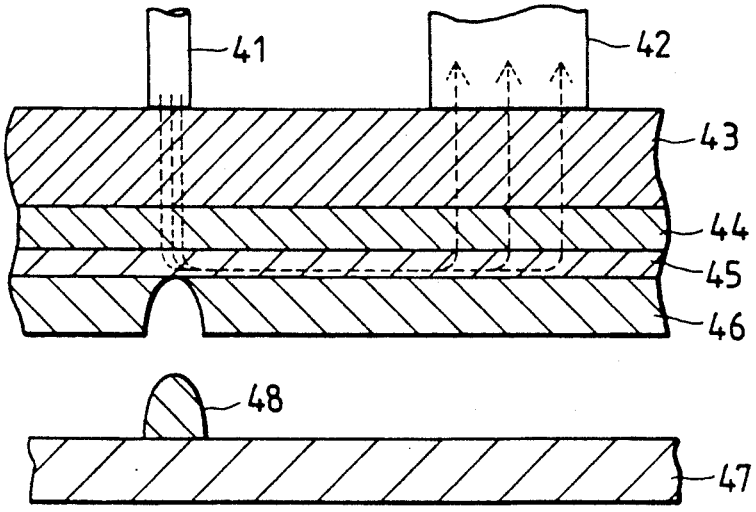
FIG. 4 is a sketch of a recording process employing a conventional thermal ink-transfer recording medium.

A diagram of an apparatus for performing thermal ink-transfer recording with the medium of the present invention is shown in FIG. 3. The medium 30 supplied from a roll 31 is transported in superposition on a receiving sheet 33 in such a way that the heat-fusible ink layer 15 is in contact with the latter. When the medium 30 reaches a backup roll 36, thermal ink-transfer recording is performed in response to electrical signals from stylus electrodes on a stylus head 35. After the recording is completed, the recording material 30 is passed through transport rolls 34 and the receiving sheet 33 is separated from the medium and the medium 30 is wound on a takeup roll 32. During the recording process, the electrical signals supplied from the stylus electrodes to the anisotropically conductive layer flow through the conduction channels formed by the conductive particles in the anisotropically conductive layer across its thickness, and thence reach the pickup electrode 13 by way of the heat generating resistive layer 12. The heat generated from the heat-generating resistive layer 12 upon application of a current is transferred to the heat-fusible ink layer 15 by conduction so as to melt the ink in the heated areas of that layer. The melted ink is transferred to the receiving sheet to produce a desired record.

The following example is provided for the purpose of further illustrating the present invention but is in no way to be taken as limiting.

EXAMPLE

Nickel particles having an average size of 20 μm with the standard deviation of size distribution being 7 μm were dispersed with a space factor of 34% in a polyimide resin. The blend was shaped into a sheet in film form with a thickness of 40 μm. The sheet was heat-cured at 380° C. with a pressure of 6 kg/cm$^2$ being applied for 10 minutes, thereby forming an anisotropically electroconductive sheet of 25 μm thick. A target consisting of a mixture of $SiO_2$ and Ta was sputtered through high-frequency sputtering in argon gas atmosphere at a pressure of $3\times10^{-3}$ Torr so as to form a heat-generating resistive film of 1.5 μm thick on the anisotropic sheet. This layer had a volume resistivity of 12 Ω·cm.

In the next step, a thin aluminum film of 1500 Å thick was deposited as a pickup electrode layer on the resistive layer by vacuum evaporation. An ink release layer was then formed on the aluminum film, by coating on the aluminum film a silicone resin having a critical surface tension of 32 dynes/cm resin so as to have a thickness of 0.4 μm and heat-curing the silicone resin coating.

The so prepared ink release layer was coated with a polyester resin (melting point of 93° C.) having a phthalocyanine pigment dispersed therein. As a result, a heat-fusible ink layer was formed to a thickness of 6 μm.

After superposing the resulting thermal ink-transfer recording medium obtained through the above steps on wood-free paper, stylus electrodes with a diameter of 60 μm were placed in contact with the one surface of the medium and pulses of 100 μs were applied at different voltages of 12, 15, 17 and 20 volts, with a pressure of 2.5 kg/cm$^2$ being exerted upon a backup roller (rubber hardness: 30). The results of this thermal ink-transfer recording are summarized in the following table, from which one can see that image dots of good quality were transferred to the receiving sheet.

TABLE

| | Pulsive Voltage | | | |
|---|---|---|---|---|
| | 12 V | 15 V | 17 V | 20 V |
| State of Transferred Ink Dots | Octagonal Dots | Circular Dots | Circular Dots | Somewhat Oval Dots |
| Dot Diameter (μm) | 62 | 70 | 76 | 98 |

The thermal ink-transfer recording medium of the present invention offers the following advantage.

1) High-density recording is possible at high resolution

Chains of conductive particles form conduction paths in the anisotropically electroconductive layer across its thickness. Therefore, no power loss due to electrical resistance will occur during conduction and at the same time, there is no loss due to the spread of current over the major surface of the medium. Because of these features, the medium permits high-density recording at high resolution.

2) Stylus electrodes will cause only a small amount of damage of the medium

The anisotropically electroconductive layer reduces the contact resistance at the interface between the medium and stylus electrodes. This is effective in reducing energy loss, thereby minimizing the amount of damage of the medium that might be caused by the styli.

3)High-speed recording is possible

The heat-fusible ink layer is positioned so close to the heat-generating resistive layer that rapid heat transfer can be realized to permit recording with a time constant of not longer than 300 μsec. Furthermore, with the use of line-heads arranged in a row, the recording speed can be increased up to 200 cpm.

4) Images of high quality can be produced

A thermoplastic resin can be used as the base material of the heat-fusible ink layer and this provides greater flexibility in the choice of base materials. For instance, a colorant to be incorporated in a transparent high-molecular weight material can be selected from a broad range of candidates with color being the sole criterion. In addition, the colorant being surrounded by the high-molecular weight material is highly resistant to deterioration or decomposition on account of either direct exposure to ultraviolet rays or contact with oxygen in the air. This results in colors and color fastness that are comparable to the levels attainable by printing.

5) Faithful tone reproduction is possible

Because of good response to input electrical signals, the amount of ink to be transferred to receiving sheets can be adjusted by modulating the intensity of input signals. Therefore, instead of tone reproduction using patterning with a dot matric three or more values of density can be attained for individual ink dots. This permits the reproduction of as many as 8 to 16 half tones while retaining a high resolution of 6 to 8 lines per millimeter. Needless to say, full-color tone reproduction is also possible with the medium of the present invention.

6) Saving of energy is possible

The heat-generating resistive layer and the ink layer are situated sufficiently close to each other to reduce the energy loss that might be caused by heat diffusion. Besides this, the conduction channels through which an electric current is guided to the heat-generating layer are low in electric resistance and this will cause only a small amount of energy loss. Needless to say, the process of recording with the medium of the present invention involves no fixing step and this is another factor that contributes to lower energy consumption. Because of these energy saving features, the medium permits recording with an energy of 1000 to 1700 erg per dot at a recording density of 8 dots/mm.

7) High reliability is ensured

By controlling the resistance of the heat-generating resistive layer, the amount of heat generation can be properly adjusted. If a heat-resistant material such as a ceramic or the like is used, the heat-generating layer can be easily prepared with its thickness controlled to be about several tens agnstroms. As a further advantage, the medium ensures highly reliability because it permits consistent recording over broad temperature and humidity ranges of 5° to 30° C. and 10 to 90% RH. Therefore, from the maintenance viewpoint, a thermal ink-transfer recording method using the medium of the present invention is superior not only to laser printing and electrostatic recording processes which require humidity control during the handling of powder, but also to an ink-jet printing method which entails temperature control for the purpose of stabilizing ink viscosity, since the thermal ink-transfer recording method with the medium of the present invention does not require such a temperature or humidity control.

We claim:

1. A thermal ink-transfer recording medium comprising: an inisotropically electroconductive layer formed by dispersing an electroconductive powder with an average particle size of 10 μm to 2 mm in a thermosetting resin, shaping the blend into sheet form, and heat-curing the sheet while being compressed in the direction of its thickness, said anisotropically conductive layer having an electrical resistance in the direction of its thicknesses of 10 $\Omega/mm^2$ or less, an electrical resistance in the direction of its width of at least $10^5$ $\Omega/mm^2$, a thickness within the range of 20 μm to 5 mm, and said electroconductive powder being a granular material having a volume resistivity of 10 Ω·cm or less; a heat-generating resistive layer; a pickup electrode layer formed of a material having a volume resistivity not higher than $10^{-1}$ Ω·cm; an ink release layer formed of a thin film having a critical surface tension of 43 dynes/cm or less; and a heat-fusivle ink layer formed of a thermoplastic resin having a melting point not higher than 130° C. and a colorant dispersed therein, said heat-fusible ink layer being capable of being fused by the heat-generated from said heat-generating resistive layer.

2. A medium of claim 1, wherein the anisotropically electroconductive layer has conduction paths formed by chains of the electroconductive particles extending in the layer thickness direction.

3. A medium of claim 1, wherein the resistance of the heat-generating resistive layer is in a range of 10−3 to $10^2$ Ω·cm.

4. A medium of claim 1, wherein the thickness of each of said heat-generating resistive layer, said pickup electrode layer, said ink release layer and said heat-fusible ink layer is, respectively, within the range of 1000 Å to 3 μm, 500 Å to 5 μm, 500 Å to 6 μm and 1 to 15 μm.

5. A medium of claim 1, wherein said ink release layer comprises a fluorine resin or a silicone resin.

* * * * *

UNITED STATES PATENT AND TRADEMARK OFFICE

CERTIFICATE OF CORRECTION

PATENT NO. : 5,045,382

DATED : September 03, 1991

INVENTOR(S) : Eiichi Akutsu et al.

It is certified that error appears in the above-identified patent and that said Letters Patent is hereby corrected as shown below:

Claim 1, column 7, line 2, change "inisotropically" to --anisotropically--.

Claim 1, column 7, line 18, change "heat-fusivle" to --heat-fusible--.

Claim 3, column 8, line 10, change "10-3" to --$10^{-3}$--.

Signed and Sealed this

First Day of June, 1993

*Attest:*

Michael K. Kirk

MICHAEL K. KIRK

*Attesting Officer*

*Acting Commissioner of Patents and Trademarks*